US005791882A

United States Patent [19]

Stucker et al.

[11] Patent Number: 5,791,882

[45] Date of Patent: Aug. 11, 1998

[54] HIGH EFFICIENCY DIAPHRAGM PUMP

[75] Inventors: William V. Stucker, La Mirada; Christopher J. Taylor-McCune, Mission Viejo; Raffi Pinedjian, Seal Beach; Alfonso O. Macias, Santa Ana, all of Calif.

[73] Assignee: Shurflo Pump Manufacturing Co, Santa Ana, Calif.

[21] Appl. No.: 638,966

[22] Filed: Apr. 25, 1996

[51] Int. Cl.[6] ..... F04B 1/12; F04B 17/00

[52] U.S. Cl. ..... 417/269; 417/413.1; 417/533

[58] Field of Search ..... 417/269, 413.1, 417/533; 92/64, 71

[56] References Cited

U.S. PATENT DOCUMENTS

| | | | |
|---|---|---|---|
| 2,942,550 | 6/1960 | Carter . | |
| 2,971,470 | 3/1961 | Wein et al. . | |
| 2,991,723 | 7/1961 | Zubaty | 417/269 |
| 3,077,118 | 2/1963 | Robbins | 417/269 |
| 3,314,600 | 4/1967 | Hadley . | |
| 3,496,872 | 2/1970 | Riester et al. . | |
| 3,572,375 | 3/1971 | Rosenberg . | |
| 3,684,406 | 8/1972 | Edwards . | |
| 4,153,391 | 5/1979 | Hartley . | |
| 4,242,061 | 12/1980 | Hartley . | |
| 4,305,702 | 12/1981 | Hartley . | |
| 4,396,357 | 8/1983 | Hartley . | |
| 4,486,151 | 12/1984 | Korhonen-Wesala . | |
| 4,507,058 | 3/1985 | Shoenmeyr . | |
| 4,545,735 | 10/1985 | Ims . | |
| 4,610,605 | 9/1986 | Hartley . | |
| 4,611,529 | 9/1986 | Stricker et al. | 417/269 |
| 4,646,781 | 3/1987 | McIntyre et al. . | |
| 4,743,169 | 5/1988 | Funakawa et al. . | |
| 4,776,776 | 10/1988 | Jones . | |
| 4,797,069 | 1/1989 | Hartley et al. | 417/222 |
| 5,129,794 | 7/1992 | Beatty . | |
| 5,203,803 | 4/1993 | Shoenmeyr . | |
| 5,301,663 | 4/1994 | Small, Jr. . | |
| 5,344,292 | 9/1994 | Rabenau et al. . | |
| 5,476,367 | 12/1995 | Zimmerman et al. . | |

FOREIGN PATENT DOCUMENTS

| | | |
|---|---|---|
| 93674 | 11/1983 | European Pat. Off. . |
| 509224 | 10/1930 | Germany . |
| 1907454 | 2/1969 | Germany . |
| 404255593 | 9/1992 | Japan . |
| 654636 | 6/1951 | United Kingdom . |

*Primary Examiner*—Charles G. Freay
*Attorney, Agent, or Firm*—Frank J. Uxa

[57] ABSTRACT

A pump comprising a housing, a diaphragm mounted in the housing, a pumping member or members, and a drive, preferably a wobble plate drive, for driving the pumping member or members on intake and discharge strokes. The wobble plate is preferably mounted on a ball bearing and includes a snap retainer assembly to retain the bearing in place without force fitting. The wobble plate preferably defines one or more open ended chambers in which the pumping member or members are placed. The annular zone or zones of the diaphragm which flex when driven by the wobble plate drive to provide the pumping action are configured to increase efficiency and/or to reduce wear.

21 Claims, 5 Drawing Sheets

11
13
35
29
17
19
25
2
30
15
2
27
23
21

35
31
83
87

97
30
85
30
89
19
105
85
21
91
87
87
99
83
30
83

HIGH EFFICIENCY DIAPHRAGM PUMP

BACKGROUND OF THE INVENTION

Diaphragm pumps possess many advantages and are widely used. A reciprocating drive can be used for a diaphragm pump. A nutating or wobble plate drive can also be used to drive a diaphragm pump, and such construction is shown in U.S. Pat. No. 4,153,391 and U.S. Pat. No. 4,610,605. The disclosure of each of these U.S. Patents is incorporated in its entirety herein by reference. Although a wobble plate drive provides a type of back and forth motion, it is quite different from linear reciprocation.

The pumps disclosed in the above-noted U.S. Patents provide very satisfactory performance. However, it would be advantageous to provide pumps which provide even more benefits.

Prior art wobble plate pumps have employed ball bearings which have been friction-fit to ensure that the bearing remains in position relative to the wobble plate. Such friction-fitting can result in putting substantial amounts of stress on the wobble plate so that the wobble plate can fracture or otherwise become damaged. This is particularly true when the wobble plate is made out of a polymeric material.

The diaphragms of pumps, for example, wobble plate pumps, often include regions which flex as the pistons are driven. Because of this flexing, these regions are prone to substantial wear which can reduce the life of the diaphragm.

SUMMARY OF THE INVENTION

This invention provides a diaphragm or gasket pump, preferably a wobble plate pump, which is easy and inexpensive to produce and assemble, achieves outstanding performance and efficiency and has a long effective life.

In one aspect of the present invention, the pumps comprise a housing including first and second housing sections, a gasket or diaphragm between the first and second housing sections, at least one fastener for holding the first and second housing sections together, a first pumping member or piston, and a drive, for example, including a wobble plate, as described herein, for moving the pumping member. The housing has at least a first pumping chamber, an inlet, an inlet passage in the housing leading from the inlet to the pumping chamber, an outlet and an outlet passage in the housing leading from the pumping chamber to the outlet. The first pumping member is movable in the first pumping chamber on an intake stroke whereby a fluid from the inlet passage is drawn into the first pumping chamber and a discharge stroke whereby fluid in the first pumping chamber is discharged into the outlet passage. The first pumping member is preferably integral with the diaphragm. The drive moves the pumping member on the intake and discharge strokes. The pumping member is operatively secured to the drive. Preferably, the drive includes a wobble plate operatively secured to the pumping member for driving the pumping member and a wobble mechanism mounted in the housing for imparting wobbling motion to the wobble plate.

According to one feature of the present invention, the drive includes a wobble plate mounted on a ball bearing and operatively secured to the pumping member. A snap retainer assembly is included in the wobble plate and is effective in retaining the ball bearing in position. The snap retainer assembly includes a first segment or shelf substantially parallel to the nutating axis of the wobble plate, a second segment or shelf oriented at an acute angle, preferably in the range of about 30° to about 60°, relative to the nutating axis, and a third segment or shelf substantially parallel to the nutating axis. A particular example of such a pump is that disclosed in U.S. Pat. No. 4,610,605 modified as described herein, for example, to include such a snap retainer assembly.

The use of the present snap retainer assembly effectively maintains or retains the ball bearing in the proper position relative to the wobble plate, for example, without the necessity for friction, force or interference fitting being primarily responsible for positioning the ball bearing. Some friction or interference fitting between the bearing and wobble plate is desirable to ensure proper and effective transfer of energy to the wobble plate. Because of the snap retainer assembly, reduced stress is placed on the wobble plate so that this component has a longer life. This is particularly advantageous when the wobble plate is made of a polymeric material, which is preferred because of reduced cost and weight.

The present snap retainer assembly allows the ball bearing to be inserted into position surrounded by the wobble plate. Once the ball bearing is in this position, the snap retainer assembly is oriented so that the ball bearing is, in effect, locked in place. This is accomplished without undue stress or force being applied to the wobble plate.

In one particularly useful embodiment, the first, second and third segments or shelves are located on a movable tab formed between two spaced-apart openings in the sidewall of the wobble plate. More preferably, the snap retainer assembly includes two or three or more of such movable tabs. The openings in the sidewall of the wobble plate preferably have first and second ends, with the first ends being open and the second ends being closed. This facilitates the selected and limited movement of the tab or tabs, as desired.

The housing preferably has a second pumping chamber, with the inlet passage leading from the inlet to the second pumping chamber, and the outlet passage leading from the second pumping chamber to the outlet. Preferably, the pump includes a second pumping member movable in the second pumping chamber on an intake stroke whereby a fluid from the inlet passage is drawn into the second pumping chamber, and a discharge stroke whereby fluid in the second pumping chamber is discharged into the outlet passage. The second pumping member is preferably integral with the diaphragm or gasket and the second pumping member is operatively secured to the drive, substantially as the first pumping member is constructed. A pump including three pumping chambers and three pumping members is particularly advantageous.

In another aspect of the present invention, the pumps have a wobble plate which includes one or more open-ended chambers, preferably equal in number to the number of pumping members included, having two opposing open ends. Each of the pumping members is preferably removably secured to the wobble plate, is partially located within one of the open-ended chambers and extends outwardly from both of the opposing open ends. The pumping member or members preferably have a end portion extending away from the corresponding pumping chamber which is enlarged, for example, in cross section, relative to the open end of the wobble plate from which it extends out of. The configuration of the portion of the pumping member within the open ended chamber preferably substantially corresponds with or compliments the configuration or angle of the surface of the wobble plate which contacts the pumping member. In addition, this portion of the pumping member is preferably stretched during installation of the pumping member in the wobble plate to preload the pumping member. The movement of the wobble plate is substantially completely translated into movement of the pumping member. This configuration facilitates effective securement of the pumping member to the wobble plate, and reduces wear between the diaphragm, which is preferably integral with the pumping member or members, and the wobble plate.

In one embodiment, the open ended chamber or chambers of the wobble plate include a surface which is oriented at substantially the same angle or substantially a matching angle as the bottom sidewall of the end portion of the pumping member extending away from the corresponding pumping chamber. This matching configuration makes installation of the pumping member in the wobble plate easier.

In addition, the wobble plate preferably includes a rounded top which mates or compliments the bottom of the diaphragm with which it comes in contact. This feature dissipates frictional loads so that slight movements between the wobble plate and diaphragm do not cause undue diaphragm wear or cause excessive heat buildup which can degrade the diaphragm. The lower portion of the surface of the wobble plate which defines the open ended chamber is preferably radiused or rounded so as to facilitate keeping the portion of the pumping member which extends outwardly from the open ended chamber away from the pumping chamber from tearing loose or abrading.

In yet another aspect of the present invention, the gasket or diaphragm includes a generally annular zone or region, preferably substantially circumscribing a pumping member which flexes when the pumping member is driven by the drive. In one embodiment, this region can be considered to be a convolute which facilitates the movement of the pumping member in the intake and discharge strokes, while reducing the amount of stress on the diaphragm caused by this motion. This facilitates maintaining a long effective life of the gasket or diaphragm. In a particularly useful embodiment, the thickness of the convolute increases, more preferably progressively increases, as the convolute approaches the pumping member. In other words, the portion of the convolute which is radially remote from the pumping member is more thin or less thick than is the portion of the convolute which is radially close to or adjacent the pumping member. Having a convolute which is thicker and more durable close to the pumping member is effective in offsetting the increased stress that exists close to the pumping member.

In addition, the generally annular zone of the gasket or diaphragm is matched, or partially matched, with the nutating motion of the wobble plate. This is accomplished by making the annular zone wider radially and/or deeper axially at a location remote from the nutating axis than at a location nearer the nutating axis. Preferably, the generally annular zone progressively widens radially and/or deepens axially as it extends radially outwardly of the nutating axis. By matching the shape of the generally annular zone to the nutating motion, volumetric efficiency is improved and wear is reduced.

Although the various features of this invention can be used singly or in any combination, they are preferably used together. The invention, together with additional features and advantages thereof, may best be understood by reference to the following description taken in connection with the accompanying illustrative drawings.

DESCRIPTION OF THE PREFERRED EMBODIMENT

Figure 1:
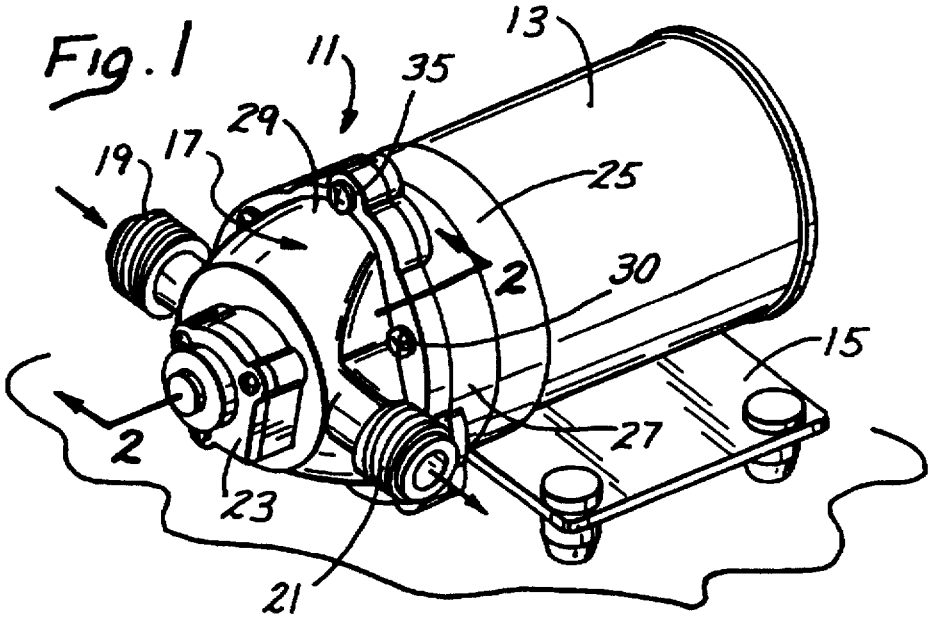
FIG. 1 is an isometric view of a pump constructed in accordance with the teachings of this invention.
Figure 4:
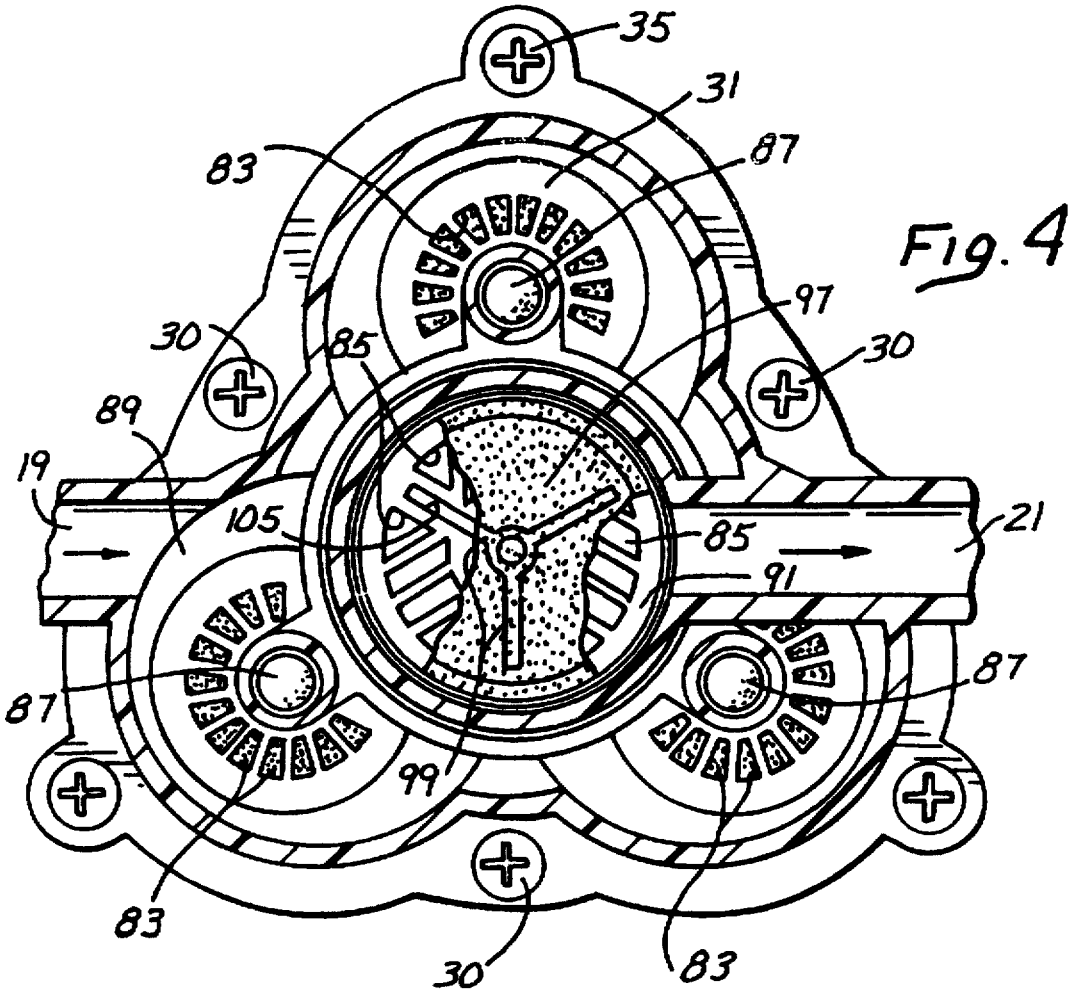
FIG. 4 is a sectional view taken generally along line 4—4 of FIG. 3.

FIG. 1 shows a pump 11 and an associated electric motor 13 mounted on a suitable base 15. As shown in FIG. 1, the pump 11 has a housing 17, an inlet 19, an outlet 21 and a pressure switch 23 mounted on the housing. The pressure switch 23 operates the pump 11 as a demand pump in that it turns the motor 13 on to drive the pump when discharge pressure falls below a predetermined level and turns the motor 13 off when the discharge pressure rises above a predetermined upper level. Pump 11 is particularly useful in pumping water, for example, in potable water systems. One very useful application is as a booster pump in reverse osmosis (RO) water systems.

Figure 2:
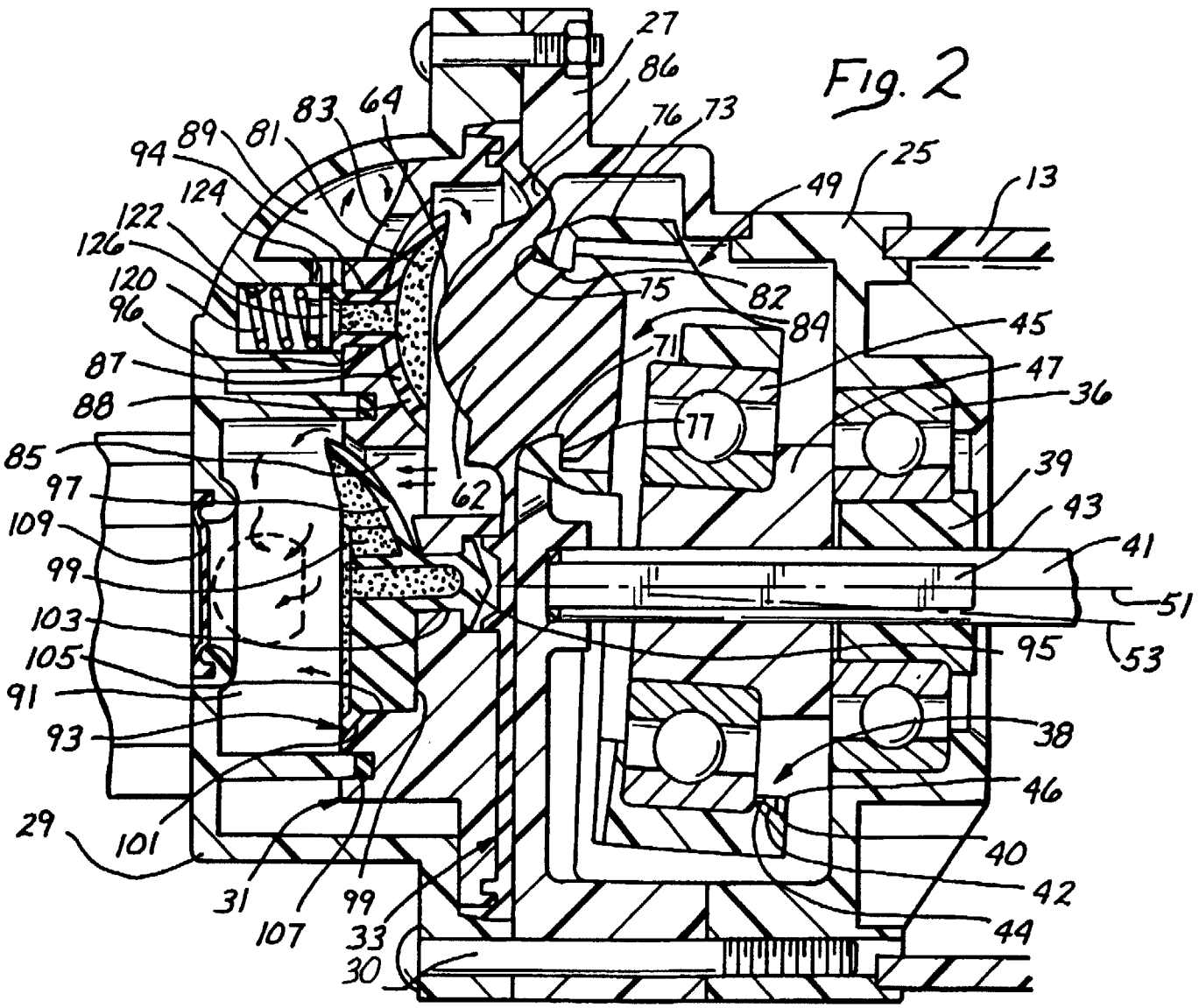
FIG. 2 is a fragmentary sectional view taken generally along line 2—2 of FIG. 1 showing one of the pumping chambers at the end of its intake stroke.
Figure 3:
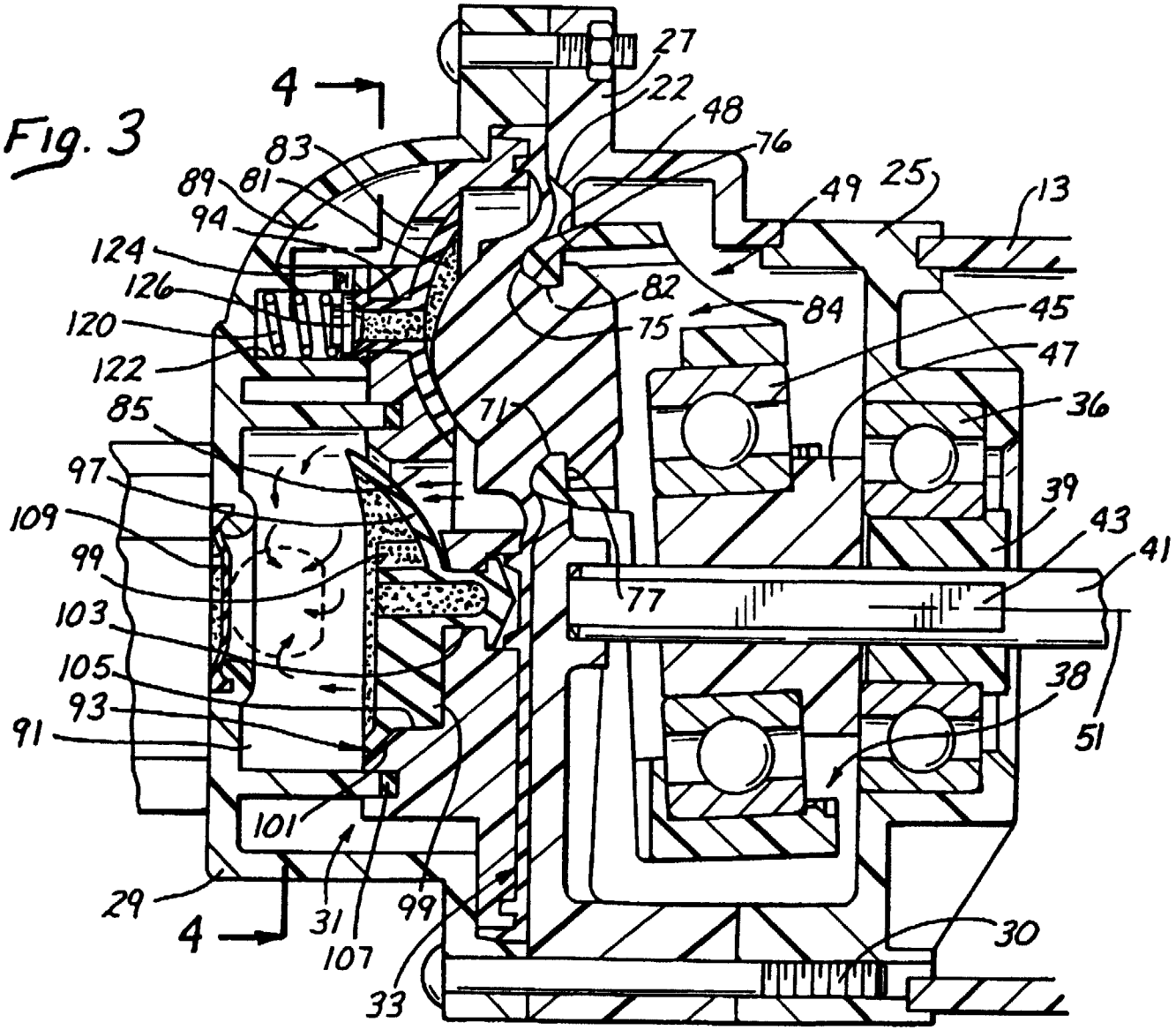
FIG. 3 is a sectional view similar to FIG. 2, with the illustrated pumping chamber completing its discharge stroke.

The housing 17, which may be of any suitable construction, in this embodiment includes a housing section 25 (FIG. 2) which may be coupled to the motor housing, an intermediate housing section 27 and a forward housing section 29. The housing section 25 can be joined to the housing section 27 and 29 by a plurality of fasteners 30 (FIG. 1–4). A valve plate 31 and a diaphragm 33 have their peripheral regions clamped between the housing sections 27 and 29, the latter being held together by fasteners 35 (FIGS. 2 and 3). The diaphragm 33 extends completely across the interior of the housing 17 and partitions the housing interior. The housing sections 25, 27 and 29 and the valve plate 31 may be integrally molded from a suitable plastic material.

As shown in FIGS. 2 and 3, an outer ball bearing 36 is mounted in the housing section 25 and receives a bushing 39 which in turn is drivingly coupled to an output shaft 41 of the motor 13 by virtue of a flat 43 on the shaft and a corresponding flat (not shown) on the bushing 39. An inner ball bearing 45 is mounted on the motor shaft 41 by an eccentric bushing 47. A wobble plate 49 is mounted on the outer race of the ball bearing 45. With this construction, the inner race of the bearing 36, the bushing 39 and the motor shaft 41 rotate about an axis 51, which is coaxial with the motor shaft, and the eccentric bushing 47 and the inner race of the ball bearing 45 rotate about a nutating axis 53. The axes 51 and 53 intersect at a point 55 in the plane of the diaphragm 33 in all rotational positions.

Figure 8:
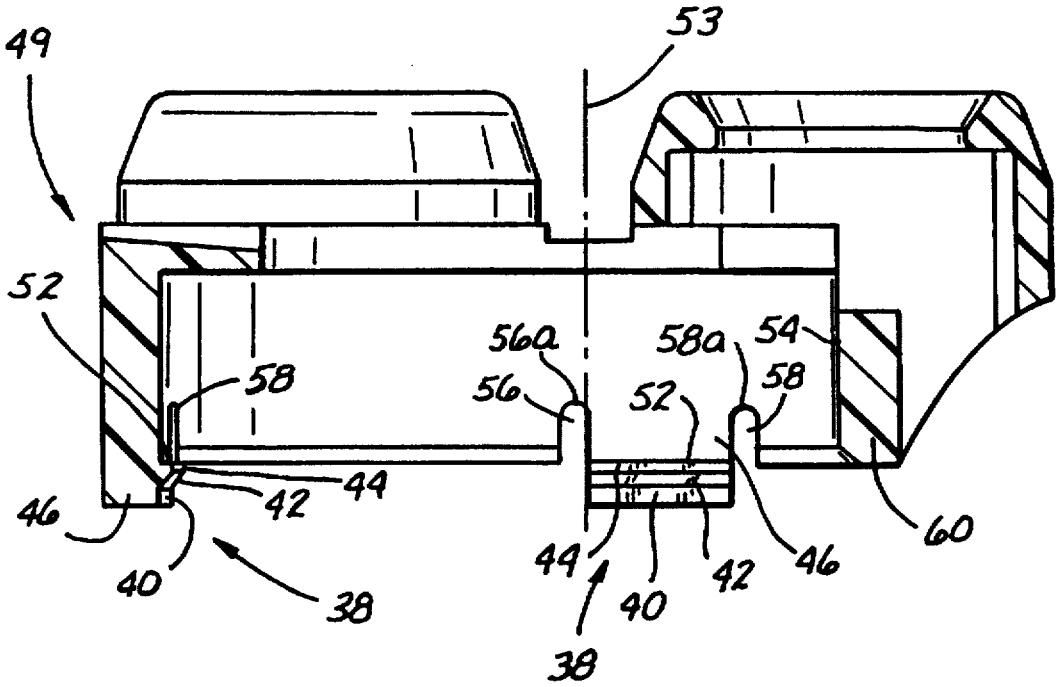
FIG. 8 is an elevation view, partly in section, of the wobble plate taken generally along the centerline of the wobble plate.

Wobble plate 49 is made of a suitable polymeric material. In order to maintain bearing 45 secured to the wobble plate 49, a snap retainer assembly, shown generally at 38, is provided in the wobble plate. As best shown in FIGS. 2 and 8, snap retainer assembly 38 includes a plurality of movable tabs 46 each of which has a first segment 40 parallel to axis 53, a second segment 42 oriented at about 450 relative to axis 53 and a third segment 44 parallel to axis 53. In the embodiment illustrated, there are three equally spaced apart movable tabs 46, although only two are shown in FIG. 8. In each movable tab 46, first segment 40 is located radially outwardly of third segment 44, and second segment 42 joins or connects with both the first and third segments. The top surface 52 adjacent third segment 44 forms a lip which extends inwardly from the inner surface 54 of the wobble plate 49. The three segments 40, 42 and 44 are located on each of the movable tabs 46 which are each formed by two spaced apart openings 56 and 58 in the sidewall 60 of wobble plate 49. Each of the openings 56 and 58 are open at the bottom and closed at the top. In addition, the closed tops 56*a* and 58*a* of openings 56 and 58, respectively, are rounded, in particular form an arc of a circle, as shown in FIG. 8. Such rounding, as opposed to squared off top openings have been found to facilitate effective operation of the snap retainer operation while reducing the risk of breaking or otherwise damaging the movable tab.

In assembling pump 11, the bearing 45 is passed across snap retainer 38. The configuration of snap retainer 38 causes the wobble plate 49 to flex in response to the force of the bearing so that the bearing can be relatively easily placed into the position as shown in FIG. 2. In particular, the force of the bearing 45 against the angled second segments 42 causes the tabs 46 to move radially outwardly, allowing the bearing to be placed in position. Once in position, the configuration of snap retainer 38 effectively prevents the bearing 45 from separating from the wobble plate 49. Thus, as the bearing 45 is placed in position, the movable tabs 46 move (or snap) back to their original position. The bearing 45, in position, is in contact with the lips 42 of the tabs 46. The bearing 45 may exert a downward (in FIG. 8) force on the lips 52. However, this downward force is not sufficient to cause the tabs 46 to move radially outwardly. Thus, the bearing 45 is effectively retained in position without force fitting, which can result in harming, for example, fracturing, the polymeric wobble plate 49.

The bearings 36 and 45, the bushings 39 and 47 and the wobble plate 49 form a wobble plate drive. With this construction, the wobble plate 49 is subjected to nutating motion.

The wobble plate 49 is received within the housing 17 and defines three open ended chambers 71. The three outer walls 73 of wobble plate 49 which surround the chambers 71 are received in three openings of intermediate housing section 27. Each of the open ended chambers 71 of wobble plate 49 includes a first end opening 75 and an opposing second end opening 77. The inner surface 76 of the wobble plate 49 between the openings 75 and 77 is oriented at an angle relative to the axis 53. The first end opening 75 and second end opening 77 are radiused or rounded so as to reduce the stress and/or wear on the portions of the diaphragm 33 which come into contact with these openings. This enhances the useful life of diaphragm 33.

The pumping members 37 are integral with the diaphragm 33, which is preferably made of a suitable flexible, resilient material, which may be a polymeric material or an elastomer. Sanoprene, an elastomer sold by Monsanto, is more preferred. The pumping members 37 include an outer sidewall or surface 82 which corresponds or compliments the inner surface 76 of the wobble plate 49 defining the chambers 71. The pumping members 37 include an enlarged member or foot 84 which has a larger cross-sectional area than second end opening 77. The pumping members 37 are received in the chambers 71 of the wobble plate 49 and are snap fitted or pushed, for example, using force from a mechanical press, so that the enlarged member 84 passes through and extends outwardly from second end opening 77.

The pumping members 37 include a head portion 62 which extends outwardly from the first end opening 75. Head portion 62 includes a central piston surface 64 which partially defines a pumping chamber 81. Diaphragm 33 includes an annular zone 86 which circumscribes central piston surface 64 and which flexes as the pumping member 37 moves between inlet and discharge strokes. No separate sealing diaphragm is needed in view of the configurations of the diaphragm 33 and pumping members 37.

Figure 7:
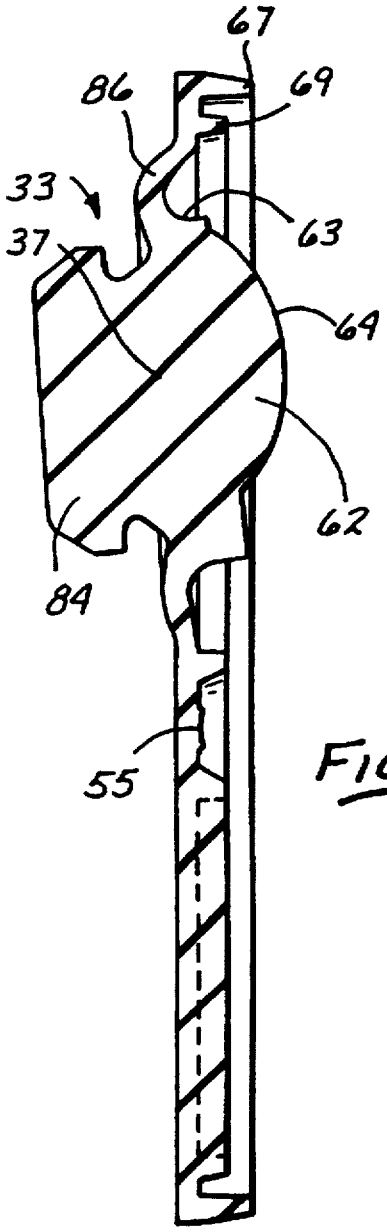
FIG. 7 is a sectional view taken generally along line 7—7 of FIG. 5.
Figure 5:
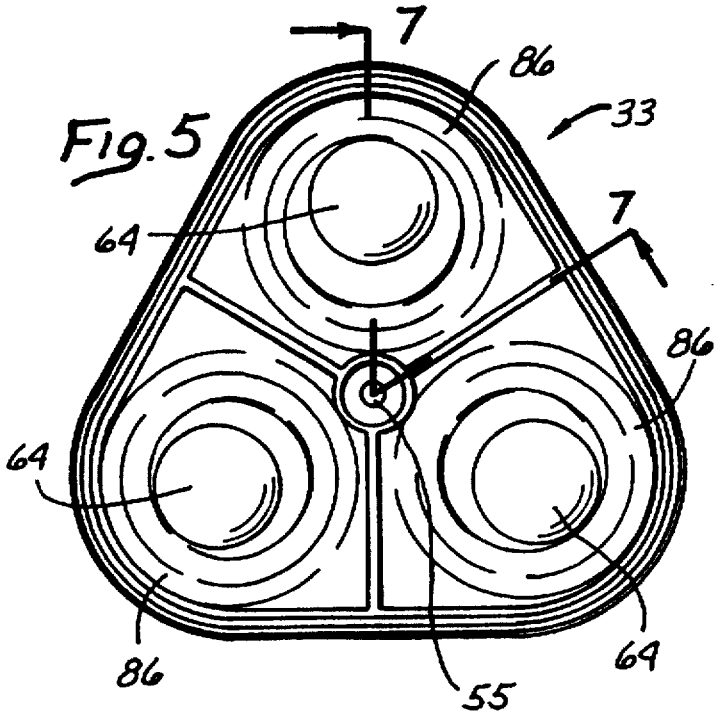
FIG. 5 is a top plan view of a preferred form of diaphragm.
Figure 6:
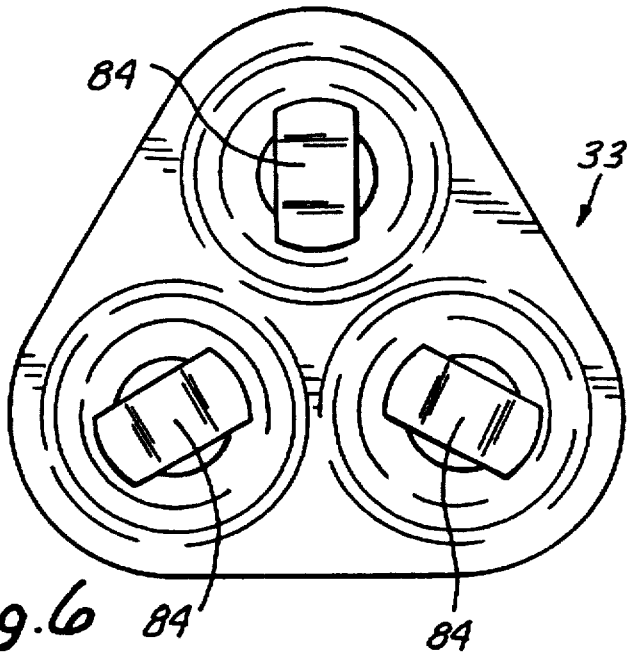
FIG. 6 is a bottom plan view of the diaphragm.

The preferred construction for the flexible diaphragm 33 is shown in FIGS. 5 to 7. The diaphragm 33 has peripheral ribs 67 and 69 for sealingly engaging the housing section 29 and the valve plate 31, respectively. Each of the annular zones 86 is in the form of a convolute which progressively deepens axially as it extends radially outwardly of the point 55 where the nutating axis 53 intersects the axis 51. The thickness of diaphragm 33 progressively increases in annular zones 86 from a point remote from the pumping member 37 to a point adjacent the pumping member. Each of the annular zones 86 includes an inner sidewall surface 63 (FIG. 7) adjacent piston surface 64 which is curved or rounded, for example, forms an arc of a circle when viewed in cross-section, as in FIG. 7. Each of these features, that is a progressively deepened convolute, a progressively thickened diaphragm and a curved inner sidewall surface, described in this paragraph increases the effective life of the diaphragm, for example, by more effectively accommodating the motion, for example, the nutating motion, of the pumping member, by increasing the durability and strength of the diaphragm and/or by reducing stress concentrations caused by the motion of the pumping member.

As shown in FIG. 2, diaphragm 33 (including pumping member 37 and surface 64) cooperates with the valve plate 31 to define pumping chamber 81. Other regions of the diaphragm 33 cooperate similarly with corresponding structures to define two other identical pumping chambers. The pumping chamber 81 has an inlet 83 (FIGS. 2–4) extending through the valve plate 31 and an outlet 85 which also extends through the valve plate. One resilient inlet valve 87 is mounted on the valve plate 31 for each of the pumping chambers 81 and is adapted to overlie an associated inlet 83. Each of the inlet valves 87 may be of conventional construction and include a central mounting portion 94 received in a bore 96 of the valve plate 31 and a resilient section 88. The inlets 83 communicate with a common inlet chamber 89 which leads to the inlet 19. The outlets 85 lead to a common outlet chamber 91 which is in communication with the outlet 21.

A common outlet valve 93 of one-piece integral construction is carried by the valve plate 31 and may be molded from a suitable material, such as rubber. The outlet valve 93 has a central, generally cylindrical mounting portion 95 for mounting the valve on the valve plate and a concave, part-spherical, resilient section 97 surrounding the central mounting portion. The outlet valve 93 also has three radially extending webs 99 spaced apart 120 degrees and extending in both axial directions from the resilient section 97. The number of webs equals the number of pumping chambers.

The valve plate 31 has a generally concave recess 101 for receiving the concave, resilient section 97, and the mounting portion 95 extends through a bore 103 in the valve plate 31. The valve plate 31 also has three slots 105 (FIGS. 2–4) which extend radially between the outlets 85 of adjacent pumping chambers 81. Regions of the webs 99 on the convex side of the resilient section 97 are received within the slots 105, respectively. With this arrangement, resilient portions of the resilient section 97 cover the outlets 85 of the three pumping chambers 81, respectively. These resilient portions would lie between adjacent webs 99 and lift off the associated outlet 85 as shown in FIG. 3; however, the webs 99 locally stiffen the outlet valve 93 so that the outlet valve can seal the other outlets 85 from the other pumping chambers 81 when one of the pumping chambers is discharging liquid through its associated outlet into the outlet chamber 91. In addition, the portions of the web 99 that are received in the slots 105 cooperate with the slots to further tend to provide a seal between adjacent pumping chambers. In this regard, the webs 99 may be received in the associated slots 105 with some looseness or a friction fit. In this manner, a single outlet valve 93 controls outlet flow from multiple pumping chambers into a common outlet chamber.

As shown in FIGS. 2 and 3, the outlet chamber 91 can be sealed to the valve plate 31 by an O-ring seal 107. A diaphragm 109 isolates the pressure switch 23 from the fluid in the outlet chamber 91.

Although the pump 11 is adapted to pump various fluids, it is particularly adapted for the pumping of water. If the pressure in the outlet chamber 91 is below a predetermined lower level, the pressure switch 23 closes a circuit to the motor 13 to bring about rotation of the shaft 41, and nutating motion of the wobble plate 49 and the pumping members 37. This nutating motion periodically flexes the annular zones 86 of the diaphragm 33 to provide a nutating pumping action in each of the pumping chambers 81. The annular zones 86 allow the nutating pumping motion to occur, and the annular zones are tailored to the nutating motion of the pumping members 37. Thus, the annular zones 86 are deeper axially at radial outward locations than at radial inward locations. Also, the angles of the surface 22 (FIG. 3) of the housing 17 (45°) and the outer surface 48 (FIG. 3) of the wobble plate 49 adjacent thereto (20°) both of which contact annular zones 86 are selected to minimize wear and tear on diaphragm 33. With this arrangement, there is no excess or unsupported length of the annular zones 86 which can be drawn into the pumping chambers 81 during the intake stroke shown in FIG. 2 or be forced in the other direction on the discharge stroke shown in FIG. 3. Accordingly, operating pressure can be increased, volumetric efficiency is improved, and wear on the diaphragm 33 is reduced.

On the intake stroke in each pumping chamber, the pressure reduction in the pumping chamber reduces to allow the liquid in the inlet chamber 89 to open the inlet valve 87 as shown in FIG. 2 and flow into the pumping chamber. On the discharge stroke, the pressure in the pumping chamber 81 increases over what it is in the outlet chamber 91 so as to force the associated portion of the resilient section 97 away from the outlet 85. The outlet valve 93 cooperates with the valve plate 31 as described above to seal the other outlets 85 from the outlet 85 which is opened.

If desired, the present pump can be equipped with one or more bypass valves to bypass pumped fluid from the outlet to the inlet in the event of excessive outlet pressure. One useful bypass valve construction is shown in FIGS. 2 and 3. A spring 120 is located in extension 122 of bore 96. A bypass passage 124 is selected to provide fluid communication between extension 122 and inlet chamber 89. If sufficient (excessive) fluid pressure exists, the fluid pressure will cause spring 120 to compress, moving poppet 126 to the left (in FIGS. 2 and 3). This establishes fluid communication between pumping chamber 81 and inlet chamber 89 and causes the pumped fluid to be bypassed to the inlet chamber.

Although an exemplary embodiment of the invention has been shown and described, many changes, modifications and substitutions may be made by one having ordinary skill in the art without necessarily departing from the spirit and scope of this invention.

What is claimed is:

1. A pump comprising:

a housing including first and second housing sections;

a diaphragm between the first and second housing sections;

at least one fastener for holding the first and second housing sections together;

said housing having at least a first pumping chamber, an inlet, an inlet passage in the housing leading from the inlet to the pumping chamber, an outlet and an outlet passage in the housing leading from the pumping chamber to the outlet;

a first pumping member movable in the first pumping chamber on an intake stroke whereby a fluid from the inlet passage is drawn into the first pumping chamber and a discharge stroke whereby fluid in the first pumping chamber is discharged into the outlet passage;

a drive for moving the pumping member on the intake and discharge strokes, the pumping member being operatively secured to the drive, said drive including a wobble plate mounted on a ball bearing and operatively secured to the pumping member for driving the pumping member on the intake and discharge strokes and a wobble mechanism mounted in said housing for imparting wobbling motion to the wobble plate; and the wobble plate includes a snap retainer assembly to retain the ball bearing in position, the snap retainer assembly including a first segment substantially parallel to the nutating axis of the wobble plate, a second segment oriented at an acute angle relative to the nutating axis, and a third segment substantially parallel to the nutating axis.

2. The pump as defined in claim 1 wherein said first, second and third segments are located on a plurality of spaced apart movable tabs each of which is formed between two spaced apart openings in the sidewall of the wobble plate.

3. The pump as defined in claim 2 wherein said openings have first and second ends, said first ends are open and said second ends are rounded and closed.

4. The pump as defined in claim 1 wherein said wobble plate is made of polymeric material.

5. The pump as defined in claim 1 wherein said acute angle is in the range of about 30° to about 60°.

6. The pump as defined in claim 1 wherein said housing has a second pumping chamber, said inlet passage leads from said inlet to the second pumping chamber and said outlet passage leads from the second pumping chamber to said outlet, the pump including a second pumping member movable in the second pumping chamber on an intake stroke whereby a fluid from said inlet passage is drawn into the second pumping chamber and a discharge stroke whereby fluid in the second pumping chamber is discharged into said outlet passage, and the second pumping member is operatively secured to the wobble plate.

7. The pump as defined in claim 6 wherein said housing has a third pumping chamber, said inlet passage leads from said inlet to the third pumping chamber and said outlet passage leads from the third pumping chamber to said outlet, the pump including a third pumping member movable in the third pumping chamber on an intake stroke whereby a fluid from said inlet passage is drawn into the third pumping chamber and a discharge stroke whereby fluid in the third pumping chamber is discharged into said outlet passage, and the third pumping member is operatively secured to the wobble plate.

8. The pump as defined in claim 1 wherein the wobble plate has a surface which contacts the pumping member and defines a first open ended chamber having two opposing open ends and the first pumping member is removably secured to the wobble plate, is partially located within the first open ended chamber and extends outwardly from both of the opposing open ends, and the configuration of the portion of the pumping member within the open ended chamber substantially corresponds with the configuration of the surface of the wobble plate which contacts the pumping member.

9. The pump as defined in claim 8 wherein the portion of the pumping member within the open ended chamber is stretched during installation of the pumping member in the wobble plate to preload the pumping member.

10. The pump as defined in claim 8 wherein the first pumping member has an end portion extending outwardly from the open end of the first open ended chamber extending away from the first pumping chamber having a larger cross sectional area than the opening of the open end from which the end portion extends, the end portion of the pumping member extending away from the Dumping chamber has a bottom side wall and the open ended chamber of the wobble plate includes a surface which is oriented at substantially a matching angle as the bottom side wall.

11. The pump as defined in claim 8 wherein the wobble plate includes a rounded top which compliments the bottom of the diaphragm with which said rounded top comes in contact and a surface which defines the open ended chamber, and the portion of the surface extending away from the rounded top is rounded.

12. A pump comprising:

a housing including first and second housing sections;

a diaphragm between the first and second housing sections;

at least one fastener for holding the first and second housing sections together;

said housing having at least a first pumping chamber, an inlet, an inlet passage in the housing leading from the inlet to the pumping chamber, an outlet and an outlet passage in the housing leading from the pumping chamber to the outlet;

a first pumping member movable in the first pumping chamber on an intake stroke whereby a fluid from the inlet passage is drawn into the first pumping chamber and a discharge stroke whereby fluid in the first pumping chamber is discharged into the outlet passage;

a drive for moving the pumping member on the intake and discharge strokes, the pumping member being operatively secured to the drive; and said diaphragm includes a generally annular region which flexes when the pump member is driven by the drive, provided that the thickness of the generally annular region increases as the region approaches the pumping member.

13. The pump as defined in claim 12 wherein the generally annular region is in the form of a convolute.

14. The pump as defined in claim 13 wherein said drive includes a wobble plate operatively secured to the pumping member for driving the pumping member and a wobble mechanism mounted in said housing for imparting wobbling motion to the wobble plate, and said convolute is deeper axially at a location remote from the nutating axis of the wobble plate than at a location nearer the nutating axis.

15. The pump as defined in claim 13 wherein said pumping member is integral with said diaphragm and includes a face partially defining the pumping chamber, and said convolute has a curved inner sidewall surface adjacent said face of said pumping member.

16. The pump as defined in claim 12 wherein said drive includes a wobble plate operatively secured to the pumping member for driving the pumping member and a wobble mechanism mounted in said housing for imparting wobbling motion to the wobble plate, and the wobble plate is made of a polymeric material and is mounted on a ball bearing, the wobble plate includes a snap retainer to retain the ball bearing in position, the snap retainer including a first segment parallel to the nutating axis of the wobble plate, a second segment oriented at an acute angle relative to the nutating axis, and a third segment parallel to the nutating axis, said first, second and third segments being located on a movable tab formed by two spaced apart openings in the sidewall of the wobble plate.

17. The pump as defined in claim 12 wherein said housing has a second pumping chamber, said inlet passage leads from said inlet to the second pumping chamber and said outlet passage leads from the second pumping chamber to said outlet, the pump including a second pumping member movable in the second pumping chamber on an intake stroke whereby a fluid from said inlet passage is drawn into the second pumping chamber and a discharge stroke whereby fluid in the second pumping chamber is discharged into said outlet passage, said second pumping member is integral with said diaphragm and the second pumping member is operatively secured to the drive.

18. A pump comprising:

a housing including first and second housing sections;

a diaphragm between the first and second housing sections;

at least one fastener for holding the first and second housing sections together;

said housing having at least a first pumping chamber, an inlet, an inlet passage in the housing leading from the inlet to the pumping chamber, an outlet and an outlet passage in the housing leading from the pumping chamber to the outlet;

a first pumping member movable in the first pumping chamber on an intake stroke whereby a fluid from the inlet passage is drawn into the first pumping chamber and a discharge stroke whereby fluid in the first pumping chamber is discharged into the outlet passage, said first pumping member being integral with said diaphragm;

a drive for moving the pumping member on the intake and discharge strokes, the pumping member being operatively secured to the drive;

the drive including a wobble plate operatively secured to the pumping member for driving the pumping member and a wobble mechanism mounted in said housing for imparting wobbling motion to the wobble plate;

the wobble plate defining a first open ended chamber having two opposing open ends and the pumping member is removably secured to the wobble plate, is partially located within the open ended chamber and extends outwardly from both of the opposing open ends; and the portion of the pumping members within the open ended chamber is stretched during installation of the pumping member in the wobble plate to preload the pumping member.

19. The pump as defined in claim 18 wherein the end portion of the first pumping member extending outwardly from the open end of the first open ended chamber extending away from the first pumping chamber has a larger cross sectional area than the opening of the open end from which the end portion extends.

20. The pump as defined in claim 19 wherein the end portion of the pumping member extending away from the pumping chamber has a bottom side wall, and the open ended chamber of the wobble plate includes a surface which is oriented at substantially a matching angle as the bottom side wall.

21. The pump as defined in claim 18 wherein the configuration of the portion of the pumping member within the open ended chamber substantially corresponds with the configuration of the surface of the wobble plate which contacts the pumping member.

* * * * *

UNITED STATES PATENT AND TRADEMARK OFFICE

CERTIFICATE OF CORRECTION

PATENT NO. : 5,791,882
APPLICATION NO. : 08/638966
DATED : August 11, 1998
INVENTOR(S) : Stucker et al.

It is certified that error appears in the above-identified patent and that said Letters Patent is hereby corrected as shown below:

Column 5, line 4; delete “450” and insert in place thereof --45°--.

Column 9, line 31; delete “Dumping” and insert in place thereof --pumping--.

Signed and Sealed this

Seventeenth Day of July, 2007

JON W. DUDAS
*Director of the United States Patent and Trademark Office*